United States Patent [19]

Fernandez

[11] Patent Number: 4,930,564

[45] Date of Patent: Jun. 5, 1990

[54] AIRVESSEL FOR MOLDING BY EXPANSIVE WAVES

[76] Inventor: Vicente L. D. F. Fernandez, Miravalles, 5-01013 Vitoria (Alava), Spain

[21] Appl. No.: 319,955

[22] Filed: Mar. 7, 1989

[30] Foreign Application Priority Data

Mar. 21, 1988 [ES] Spain ..... 8800859

[51] Int. Cl.[5] ..... B22C 15/00

[52] U.S. Cl. ..... 164/169; 164/37

[58] Field of Search ..... 164/169, 37

[56] References Cited

U.S. PATENT DOCUMENTS 4,565,233 1/1986 Fischer et al. ..... 164/169 X
4,565,235 1/1986 Fischer et al. ..... 164/169
4,609,033 9/1986 Kobel et al. ..... 164/169
4,620,585 11/1986 Muller et al. ..... 164/169

*Primary Examiner*—Nicholas P. Godici
*Assistant Examiner*—J. Reed Batten, Jr.
*Attorney, Agent, or Firm*—Helfgott & Karas

[57] ABSTRACT

An airvessel for molding articles comprises a tank, a highly elastic membrane formed as a valve element and fixed in the tank by flanges to a support plate to form an annular chamber which may be pressurized via an air supply conduit to deform the membrane towards a closure position in which the membrane falls upon a valve seat. An opening is established in the center of the membrane-support plate assembly to which is axially coupled an outlet conduit for release of residual air which is present in a diffuser positioned below the membrane and coupled to a mold box.

3 Claims, 1 Drawing Sheet

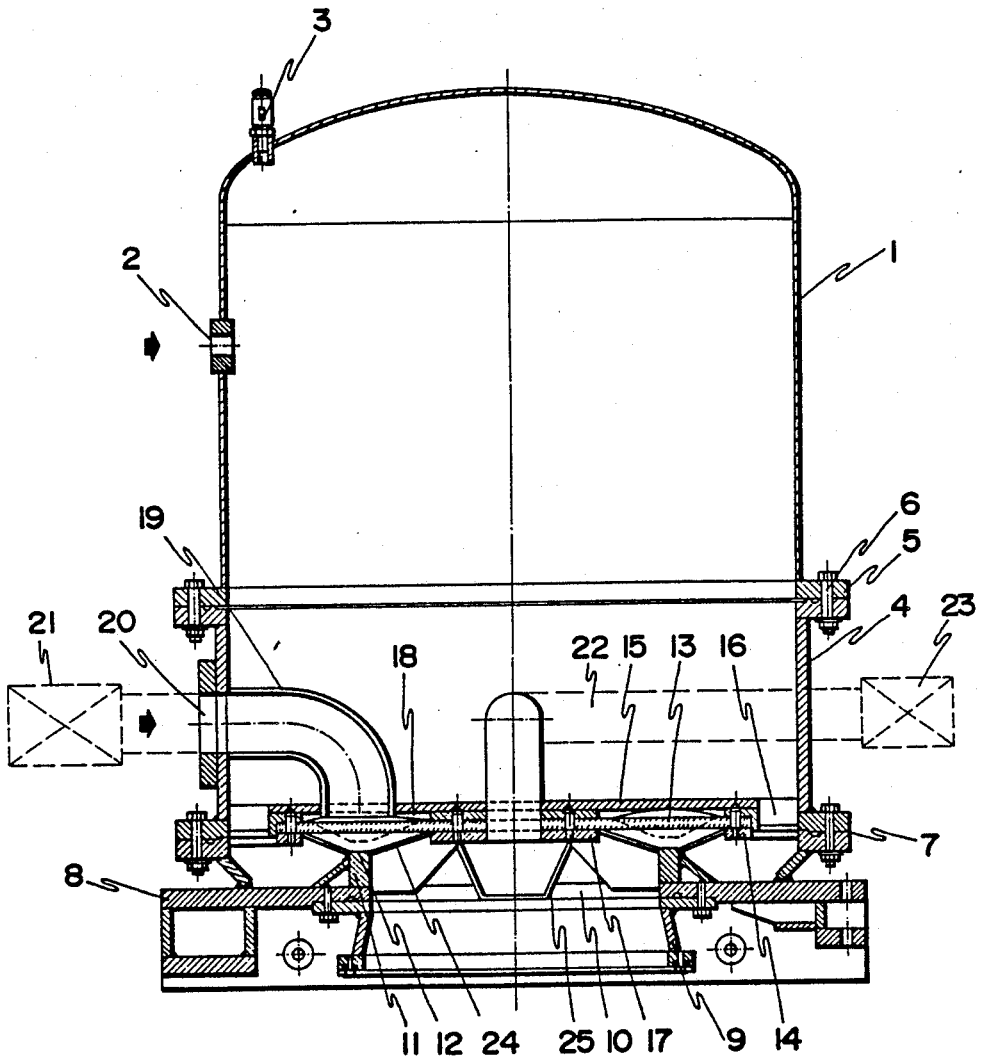
3
2
1
19
6
5
21
20
18
22
15
13
16
4
23
7
8
11
12
24
25
10
17
9
14

AIRVESSEL FOR MOLDING BY EXPANSIVE WAVES

BACKGROUND OF THE INVENTION

The present invention relates to a series of improvements introduced in airvessels used in molding expansive waves, which molding system is specifically used to conform sand molds used in casting.

This system essentially comprises introducing the sand, which falls from a chute due to the effect of gravity, into a mold box where it will be compressed due to the effect of air under pressure supplied thereto from a vessel, specifically from the vessel on which the invention is focussed.

The mold box of the molding system cited in the previous paragraph is fitted with a framework and is assembled on a table which may be displaced vertically, so that when the table is raised the mold box couples hermetically against a diffuser positioned under the vessel.

When the valve connecting the vessel and the diffuser is opened, air from the vessel enters the latter abruptly and acts on the sand which constitutes the mold, compressing same.

One of the solutions for the practical embodiment of this molding system consists in the valve located between the vessel and the diffuser, i.e., the release valve, comprising a stiff plate or disc which remains closed due to excess pressure inside a chamber where said plate plays, so that when the excess pressure disappears from said chamber, the air under pressure accumulated in the vessel can displace said closure plate towards an open position and enter abruptly into the diffuser, falling upon the sand and causing it to be compressed. When air under pressure is once again introduced into the said chamber where the plate constituting the plug or valve element plays, such plate again moves towards a closed position.

When the valve is closed, residual air under pressure, which must be eliminated, remains in the diffuser, thereby causing one of the major problems of this system. More specifically, the residual air may not be eliminated through the centre of the valve towards the vessel and from the latter to the exterior, and it must therefore be released through some side conduit provided in the framework or near the mouth of the diffuser, i.e., at all times through a conduit located near the sand mold. This causes extremely abrasive sand particles to be dragged by the residual air when it is released, and such sand particles will damage everything they find on their way.

Another disadvantage of this system lies in the fact that, bearing in mind the nature and operation of the valve, the disc causes brusque collisions and therefore noise, when changing from a closed to an open position.

Another known solution consists in using a butterfly type valve, i.e., a mechanical valve which is consequently slower when reacting than the previous valve, or at any rate reacts accordingly to what it is.

This solution, like the previous one, has the disadvantage that the residual air present in the diffuser cannot be extracted through the centre of the valve towards the vessel, and must be released through side conduits located in the framework.

Another known solution consists in the release valve comprising two superposed discs provided with openings which will allow or prevent passage of air under pressure to the diffuser, depending on whether or not the openings of one disc face the openings of the other disc. The main disadvantage of this solution is that the valve is evidently mechanical and reacts as such.

SUMMARY OF THE INVENTION

The improvements of the invention, which are specifically focussed on the valve system connecting the vessel and the diffuser, fully solve the problems set out above, allowing on the one hand the residual air of the diffuser to be extracted through the centre of the release valve itself, and towards an area which is sufficiently far from the sand mold so that sand particles are not dragged, whereas on the other hand said valve reacts quickly, and there are no stiff elements to collide against each other causing noise and wear in the materials. Complementarily a significant amount of energy is saved when such valve is maintained in a closed position, derived from the structure of the valve itself, at the same time as release from the vessel takes place almost instantaneously, air being displaced at a high speed and with hardly any turbulences.

More specifically and in order to achieve the above, the improvements set out herein are focussed on the fact that the airvessel for molding is provided with a highly elastic membrane valve which allows free flow of air from the vessel itself or tank of air under pressure towards the diffuser when the valve is inactive, but when deformed by pressure supplied to the surface of said membrane opposed to the surface which takes part in the conduction of air from the vessel to the diffuser, it leans through a circular ring of its own surface on a likewise circular rest or seat defined by the mouth of the axial duct towards the diffuser, establishing the closure. In order to achieve this deformation of the membrane, the latter conforms, with the body itself of the vessel and inside the vessel, a chamber which faces the said neck acting as a canalizer towards the diffuser, which chamber is supplied with air under pressure through the corresponding duct. In this sense and in accordance with another characteristic of the invention, this chamber which receives the valve closure pressure, adopts an annular configuration, in correspondence with the mouth of the said neck, the duct for entry of air under pressure being positioned anywhere in said annular chamber, whereas an outlet, release or escape duct is axially positioned in the centre for elimination of the residual air present in the diffuser.

In accordance with a further characteristic of the invention, the said rest neck of the membrane valve is provided with radial brackets or ribs which allow free flow of air therebetween but which act as restricting elements for the deformation of such membrane when it is subjected to a closing pressure, through their free ends facing the said membrane.

As is also clear, the pressure supplied to the membrane in order to achieve the valve closure position must be considerably greater than the pressure existing in the vessel itself and which, in accordance with the structure described, acts on the opposite surface of the membrane.

DESCRIPTION OF THE DRAWINGS

In order to complement the description being made and to assist a better understanding of the characteristics of the invention, a single sheet of drawings is attached to the present specification as an integral part thereof showing, in an illustrative and non-limiting manner, and in its only FIGURE, a side elevation and diametrical cross sectional view of a vessel made in accordance with the improvements constituting the object of the present invention.

DETAILED DESCRIPTION OF THE PREFERRED EMBODIMENT

In the light of this FIGURE it may be observed that the release vessel of the present invention is comprised, as any conventional vessel of this type, by a tank 1, containing a considerable load of air under pressure and with a pressure in accordance with the specific requirements for the practical use of such vessel, which tank is provided with the corresponding connecting nipple 2 to the feeding source of air under pressure, and a safety valve 3, tank 1 being connected to a body 4, a lower and axial extension thereof, to which it is attached by means of flanges 5 and screws 6, with the help of a tight joint, whereas body 4 and through a perimetral flange 7, is in turn attached to the base 8 of the vessel through which lower area the latter axially receives a diffuser 9, which will in turn be coupled, at a working phase of the vessel, to the mold box and through the corresponding framework.

From this structure and in accordance with the improvements set out herein, a short cylindrical neck 11 projects from the top of base 8 of the vessel and framing the wide central opening 10 for outlet towards diffuser 9, the free edge of which neck 11 defines an annular seat 12 for a membrane 13, which constitutes the valve element of the vessel, connected through an annular flange 14 to a support plate 15 which is duly stiffened to body 4 of the vessel, preferably through radial brackets which define pitches 16 in the perimetral area of plate 15, which connect the inside of tank 1 to the lower area of membrane 13, which is substantially separated from seat 12 when inactive, and therefore with the outlet opening 10 of the base of the vessel towards diffuser 9.

More specifically, membrane 13 is provided with a central opening and is fixed by flange 14 and a second flange 17 concentrically and internally related to flange 14, such than an annular chamber 18 is established between membrane 13 and support plate 15, which may be supplied with air under pressure from the exterior through a conduit 19, for which purpose such conduit 19 traverses the wall of body 4 at 20 and said conduit 19 is fitted with a control valve 21. This annular nature of chamber 18 also allows the conduit 22 to be established in the center of support plate 15, i.e., in the axial area of the vessel, for the outlet of the residual air present in diffuser 9 to the exterior, which conduit 22 is also fitted with a release or escape valve 23.

In accordance with this structure, when the pressure which reaches chamber 18 through conduit 19 is greater than the working pressure present inside tank 1, blocking membrane 13 is deformed, in accordance with the dotted line shown in the FIGURE, until it is perfectly adjusted to annular seat 12 defined by neck 11 of base 8 of the vessel, in which closure position diffuser 9 becomes independent from tank 1.

In this sense and in order to restrict deformation of membrane 13, it has been foreseen that neck 11 is fitted with radial brackets or ribs 24 the top and operative edge whereof restricts deformation of the membrane, and which brackets on the other hand limit the formation of air turbulences.

In this position of valve closure, tank 1 or the vessel itself is filled up to the required working pressure, and from this position valve 21 only has to be actuated for the pressure present in chamber 18 to be eliminated, so that air is released towards diffuser 9 with a high displacement speed, with hardly any turbulences, as has previously been mentioned, due to tangential displacement of the expansion waves through brackets 24 which act as diffusers directing the air towards the mold, also with the help of a coaxial and frustrum-of-the-cone-shaped partition wall 25 established as an extension of the mouth of release or escape conduit 22.

The special closure system of membrane 13 on its seat, through a narrow and almost linear fringe, considerably reduces the amount of air necessary for closure of such membrane to take place, thereby saving a considerable amount of energy. On the other hand, as no displaceable mechanical elements are involved, but merely a deformable elastic membrane, no materials are worn nor are there any abrupt movements or collisions which, as is the case of conventional vessels, are frequent causes of breakdowns. Finally, said membrane allows release or escape conduit 22 for the residual air present in diffuser 9 to be axially positioned, and therefore said release takes place at quite some distance from the mold and the jet of air does not drag sand particles which could act as an abrasive upon its release.

It is not considered necessary to extend the present description any further for an expert in the art to understand the scope of the invention and the advantages derived therefrom.

The materials, shape, size and arrangement of the elements may vary, provided this does not imply a modification in the essentiality of the characteristics of the invention.

The terms used to describe the present specification should be understood to have a wide and non-limiting meaning.

I claim:

1. In an airvessel for molding articles by expansive waves, comprising a tank for accumulating air until a working pressure of the vessel is reached; a base connected to said tank; a diffuser connected to said base and through which air must be suddenly released on a mold; and a valve for controlling said release, said valve being arranged within a framework itself and in positional correspondence with said diffuser, the improvement comprising said valve including a highly elastic membrane; two annular concentrical flanges; a support plate for supporting said membrane and said flanges in said tank, said membrane being connected to said support by said flanges and fastening means so that a central part of said membrane is immovable and an annular tightly sealed chamber is formed between said membrane and said support plate; a conduit for supplying pressurized air and opening into said chamber, said base having a neck portion upwardly projecting therefrom and having an upper edge defining an annular seat facing said membrane, said neck portion enclosing an opening connecting said tank with said diffuser whereby when said membrane is inactive an annular pitch is established between said membrane and said seat whereas, when pressure is applied to said chamber by said air, said membrane is deformed and closes tightly against said seat and then opens as soon as pressure supplied to said chamber is ceased; said membrane, said support plate and an internal flange of said two concentrical flanges having at a central part thereof an opening which extends axially into said tank and opens into an escape conduit at a substantial distance from said diffuser so that residual air present in said diffuser is released to an exterior of said tank at a location which is sufficiently remote from the mold.

2. The airvessel according to claim 1, wherein said neck portion is cylindrical.

3. The airvessel according to claim 2, wherein said neck portion is provided with radial ribs having top edges which form a limiting abutment for said membrane as said membrane is deformed, said ribs further acting as diffusers to prevent turbulences of air when air flows towards said diffuser.

* * * * *